US006098807A

United States Patent [19]

Umeda

[11] Patent Number: 6,098,807

[45] Date of Patent: Aug. 8, 2000

[54] GOODS HANGING MEMBER

[76] Inventor: Tohzo Umeda, 67-1 Mikuriyakitanomachi, Higashiosaka, Osaka, Japan

[21] Appl. No.: 09/232,086

[22] Filed: Jan. 15, 1999

[51] Int. Cl.[7] ..... B65D 85/00

[52] U.S. Cl. ..... 206/705; 206/806; 206/485

[58] Field of Search ..... 206/703, 705, 206/806, 820, 336, 337, 485, 477, 478, 479, 481, 483

[56] References Cited

U.S. PATENT DOCUMENTS

| | | | |
|---|---|---|---|
| 2,828,856 | 4/1958 | Deakers | 206/478 |
| 5,428,940 | 7/1995 | Paumen et al. | 206/705 |
| 5,544,755 | 8/1996 | Paumen et al. | 206/705 |
| 5,595,047 | 1/1997 | Paumen et al. | 206/705 |
| 5,947,297 | 9/1999 | Aoki et al. | 206/705 |

*Primary Examiner*—Paul T. Sewell
*Assistant Examiner*—J. Mohandesi
*Attorney, Agent, or Firm*—Mooray Kojima

[57] ABSTRACT

The present invention relates to a goods hanging member for supporting by hanging a battery (including both dry battery and storage battery) or a dry battery unit made by integrating a plural number of dry batteries and other goods, on the occasion of their display and/or sales, which can be formed with a simple and single material constituting the main board, by forming a pair of slits in the main board at a certain interval, and forming creases between the end parts of the pair of slits to turn the portion surrounded by the pair of slits and the creases into a goods holding piece and form a holding space for holding goods between the main board and the goods holding piece, and is capable of securely holding goods in a holding space, and also capable of achieving a substantial simplification of manufacturing processes.

6 Claims, 6 Drawing Sheets

GOODS HANGING MEMBER

BACKGROUND OF THE INVENTION

1. Field of the invention

The present invention relates to a goods hanging member for hanging and supporting a battery (including both dry battery and storage battery) or a dry battery unit made by integrating a plural number of dry batteries and other goods, on the occasion of their display and/or sales.

2. Description of the prior art

Conventionally, for display and sales of especially dry batteries as example of goods, there is a means which consists in integrally combining a plural number of UM-3 type dry batteries into a unit with resin film and housing this dry battery unit in good order in a casing to submit it to display and sales, but a problem with such means is that there is no way of supporting the dry battery unit by hanging and therefore no good display effects can be obtained.

To solve such problem, a goods hanging member 60 as shown in FIG. 6 is already invented.

Namely, it holds a plural number of dry batteries 61—as goods between a base board 62 and a wrapper 63 made of synthetic resin, forms a plurality of reinforcing ribs 64, 65 integrally with the wrapper 63, integrally joints the back face of this wrapper 63 and the surface of the base board 62, and forms a hanging hole 66 at the upper part of the hanging member 60.

A problem with this conventional goods hanging member 60 is that, while it has a merit of obtaining excellent display effects with hanging and supporting of goods, it requires different kinds of material i.e. paper and synthetic resin to construct the goods hanging member 60, and also requires complicated processes such as forming process of wrapper 63, jointing process of wrapper 63 and base board 62, etc., thus greatly increasing the manufacturing processes of the goods hanging member 60.

SUMMARY OF THE INVENTION

The main object of the present invention is to provide a goods hanging member which can be formed with a simple and single material constituting the main board, by forming a pair of slits in the main board at a certain interval, and forming creases between the end parts of the pair of slits in a way to turn the portion surrounded by the pair of slits and the creases into a goods holding piece and form a holding space for holding goods between the main board and the goods holding piece, and is capable of securely holding goods in a holding space, and also capable of achieving a substantial simplification of manufacturing processes.

Another object of the present invention is to provide a goods hanging member capable of hanging and supporting a plurality or large number of goods in limited space, by forming a plurality of holding spaces in either the transversal or longitudinal direction of the main board.

Still another object of the present invention is to provide a goods hanging member capable of preventing displacement in transversal direction of the goods held in the holding spaces, by forming displacement preventing pieces through crease on both sides of the holding spaces.

Yet another object of the present invention is to provide a goods hanging member capable of improving the durability of hanging and supporting against the weight of the goods to be hung, by forming hangers for hanging goods held in the holding spaces at the upper part of the main board, and forming those hangers in a multilayer structure with folding of the main board.

A further object of the present invention is to provide a goods hanging member capable of preventing deformation (warping) of the hanging member, by providing holding spaces in the transversal direction of the main board and forming slits in the shape of arcs so that the intermediate part of adjoining slits may be depressed, to thereby increase the width of the intermediate part of the main board in correspondence to the slits in the shape of arcs in which the intermediate part is depressed while improving the workability of entry and take-out of goods into and from the holding spaces, thus preventing deformation (warping) of the hanging member with this width.

A still further object of the present invention is to provide a goods hanging member which can be formed with a simple and single material constituting the main board, by setting the goods as a battery or a dry battery unit made by integrating a plural number of dry batteries, and is capable of securely holding either the battery or the dry battery unit in a holding space, and also capable of achieving a substantial simplification of manufacturing processes.

Yet further object of the present invention will become clear easily from the description of the embodiment to be presented hereafter.

DESCRIPTION OF THE PREFERRED EMBODIMENT

An embodiment of the present invention will be described in detail hereafter by referring to drawings.

Figure 5:
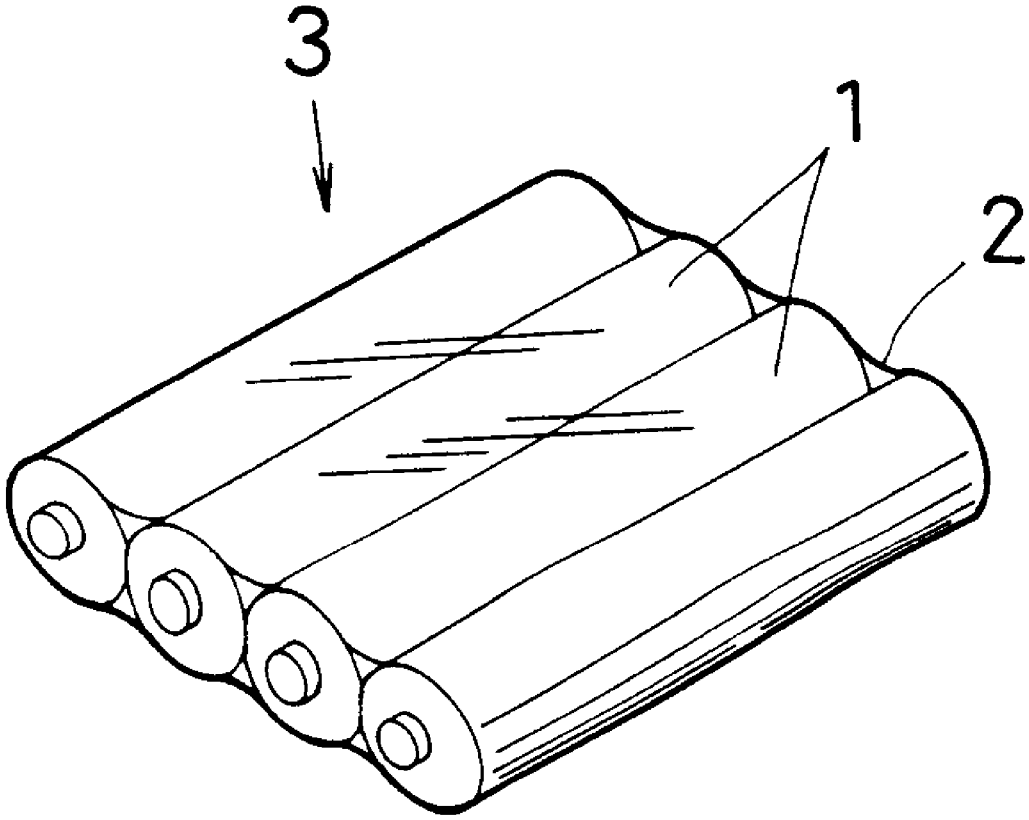
FIG. 5 is a perspective view showing a dry battery unit.
Figure 6:
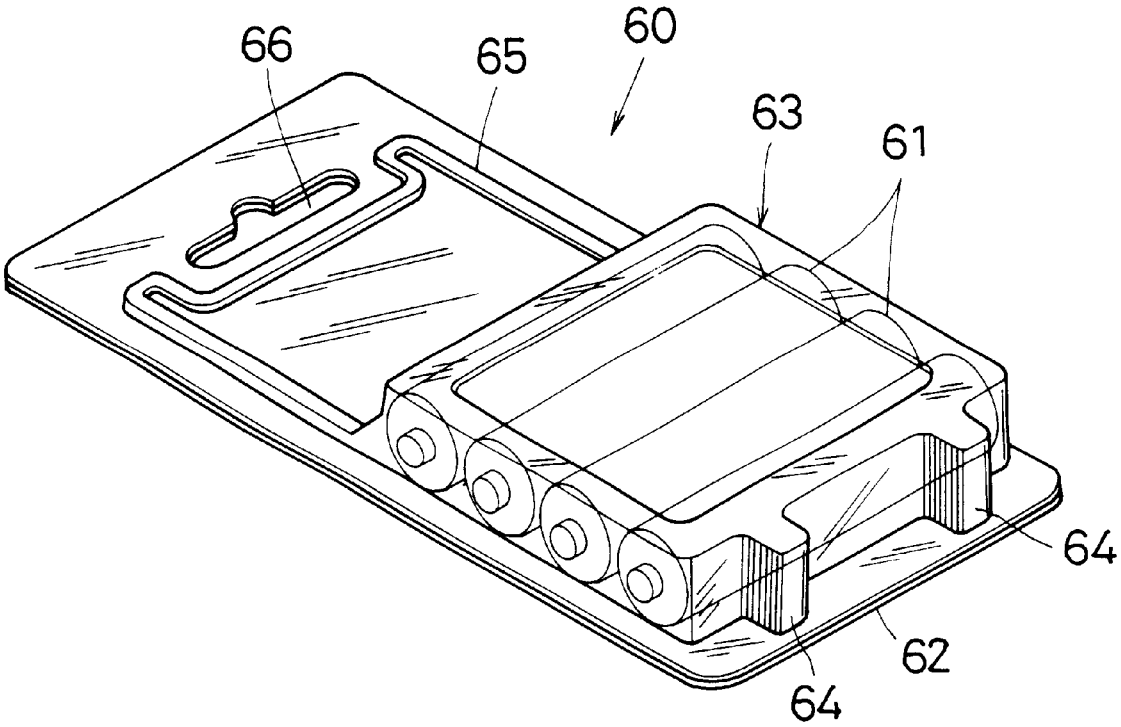
FIG. 6 (PRIOR ART)
FIG. 6 is a perspective view showing a conventional goods hanging member.

The drawings show a goods hanging member. In the present embodiment, a dry battery unit will be given as example of goods, made by integrating a total number of 4 UM-3 type dry batteries 1 with resin film 2 as shown in FIG. 5.

Figure 1:
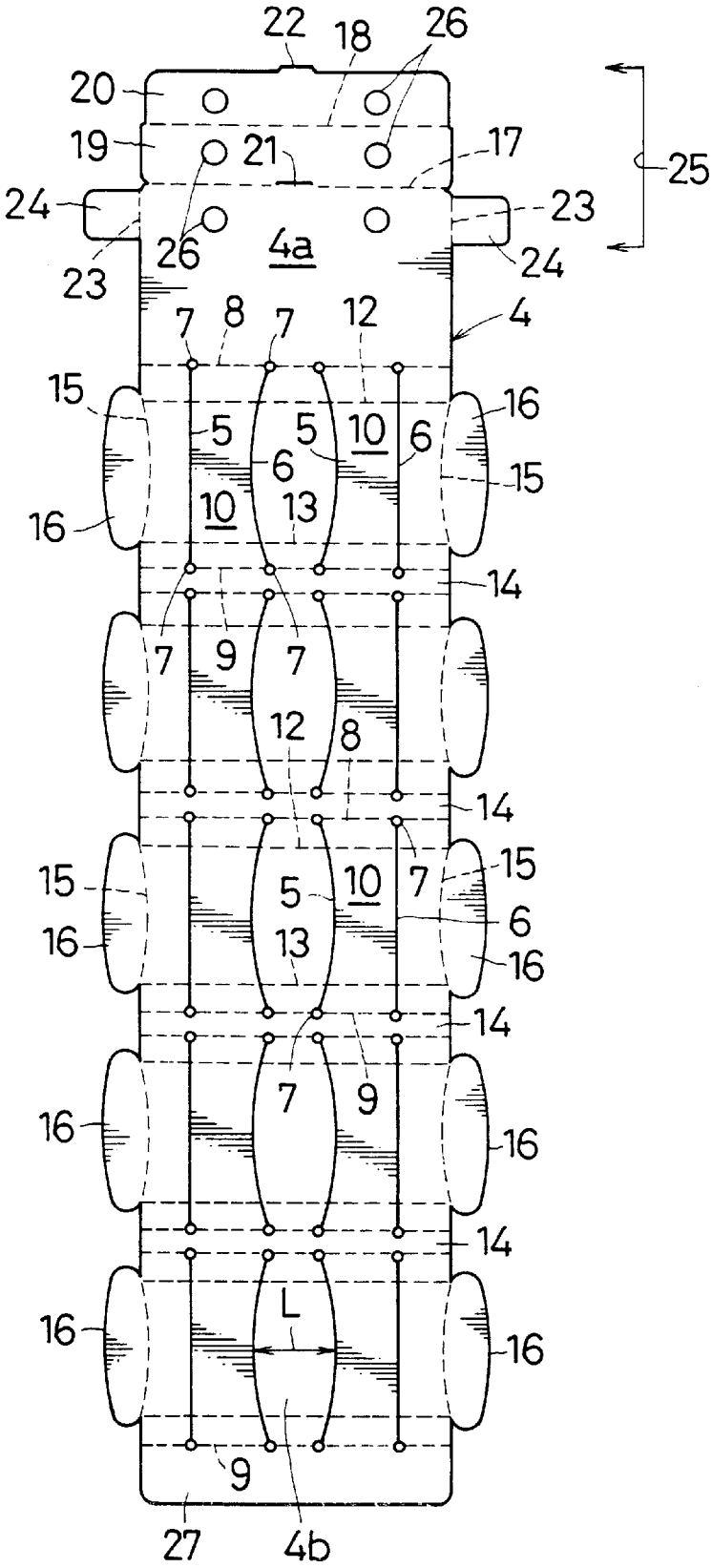
FIG. 1 is a developed plan of a goods hanging member according to the present invention.

FIG. 1 indicates a goods hanging member in a developed state, providing a main board 4 made of polyester resin with a thickness of approximately 350 microns, and forming, on this main board 4, a pair of about parallel slits 5, 6 (so-called ruled lines) facing in the vertical (longitudinal) direction at a certain interval.

Figure 3:
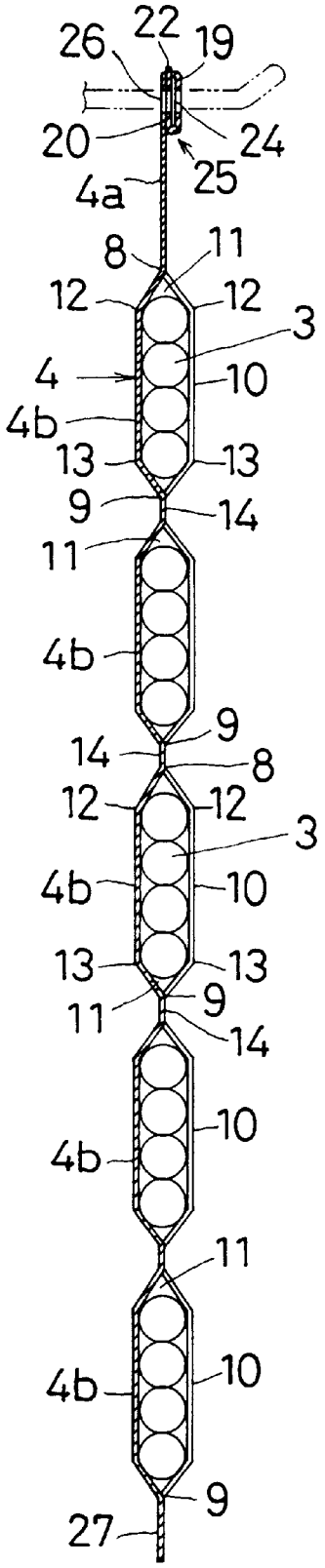
FIG. 3 is a side sectional view along the line A—A in FIG. 2.

This goods hanging member is constructed by forming small drilled holes 7, 7 at both the top and bottom ends of the slits 5, 6 to prevent cracking of the main board 4, and constructed by forming creases 8, 9 in the entire area in the direction of breadth of the main board 4 including the area between the end parts of a pair of slits 5, 6 and turning the portion surrounded by the pair of slits 5, 6 and the creases 8, 9 into a goods holding piece 10, so as to form a holding space 11 (holder) as indicated in FIG. 3 by separating the goods holding piece 10 from the main board 4 along the creases 8, 9.

This holding space 11 is a space for holding the dry battery unit 3 in a way to enable entry and take-out and, in this embodiment, the holding space 11 is formed in the number of 2 in the transversal direction and in the number of 5 in the longitudinal direction of the main board 4, so as to hang and support a total number of 10 pieces of dry battery unit 3. However, the number of holding space 11 to be formed in both the transversal and longitudinal directions is not restricted to above but presence of at least one holding space 11 will be enough.

Moreover, below and close to the crease 8 on the top side is formed a crease 12 for shaping a space 10 parallel to this crease 8, while a crease 13 for shaping a space 10 parallel to the crease 9 on the bottom side is formed above and close to this crease 9.

In this embodiment, connecting pieces 14—are provided between the crease 9 on the bottom side of the upper stage side and the crease 8 on the top side of the lower stage side, because the holding space 11 is formed in the number of 5 (5 stages in vertical direction) in the longitudinal direction.

Furthermore, on both sides of the holding spaces 11, 11 provided side by side in transversal direction are formed displacement preventing pieces 16, 16 through arched creases 15, 15 in vertical direction connecting between edges of the creases 12, 13. While a displacement preventing piece 16 is given in about an elliptical shape in this embodiment, it may also have a square shape. In the case where a single or a string of holding spaces 11 are formed, the displacement preventing piece 16 may be formed on both sides thereof through the crease 15.

On the upper piece 4*a* of the main board 4 are formed bending pieces 19, 20 through two creases 17, 18 extending in the direction of breadth, and a notch 21 is formed in the intermediate part of the crease 17, while an engaging slip 22 to be engaged in the notch 21 is integrally formed in the intermediate part at the top of the bending piece 20.

Still more, at the left and right top ends of the upper piece 4*a* of the main board 4 are formed projections 24 through the creases 23 in vertical direction.

Figure 2:
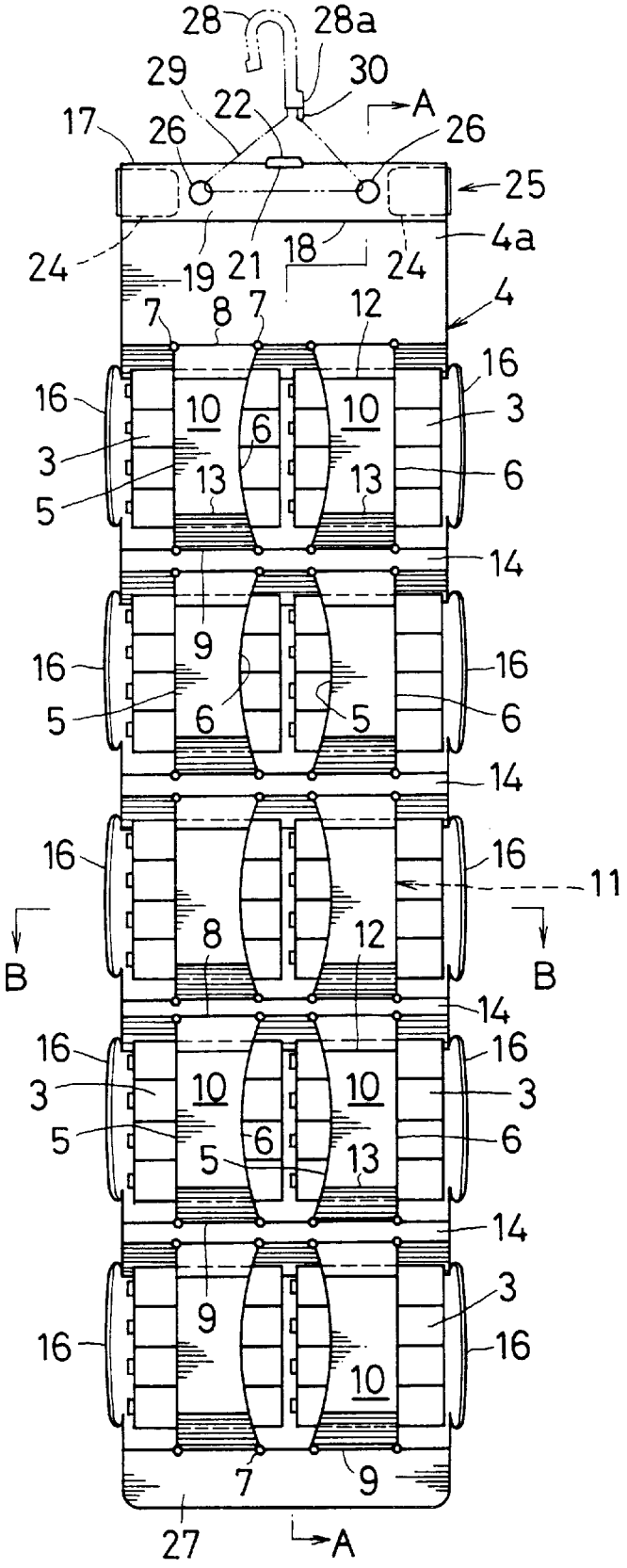
FIG. 2 is a front elevation showing the state in which the goods are inserted.

And, as the projections 24 on both the left and right sides are inserted between the respective bending pieces 19, 20 after one bending piece 20 is bent on the other bending piece 19 and the engaging slip 22 is inserted in the notch 21, a hanging unit 25 of a 3-layer structure composed of the respective elements 4*a*, 19, 20 as shown in FIG. 2, FIG. 3 is formed at the top of the main board 4.

In addition, in the upper piece 4a and the bending pieces 19, 20 are formed, by drilling, a total number of 6 engaging holes 26 in a way to mutually agree when those pieces are placed one upon another.

Figure 4:
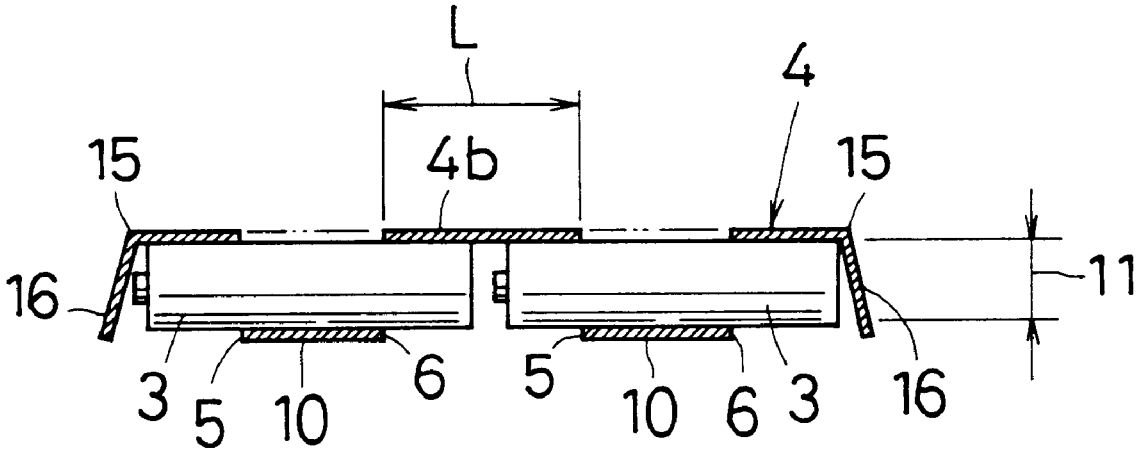
FIG. 4 is an expanded sectional view along the line B—B in FIG. 2.

On top of that, in the case where the holding spaces 11 (see FIG. 2, FIG. 3) are provided side by side in the transversal direction of the main board 4, the creases adjoining in the holding spaces 11 provided side by side i.e. the crease 6 on the left side at the center and the crease 5 on the right side at the center in FIG. 1 are formed in the shape of an arc so that the intermediate part in vertical direction of those creases 5, 6 may be depressed, and the width L at the center, which forms the back holding piece 4*b* (see FIG. 3, FIG. 4) of the main board 4 in correspondence to the arched creases 6, 5 with the intermediate part depressed, is set to be large as shown in FIG. 1, FIG. 4, so as to prevent deformation by warping of the goods hanging member with this width L.

On the other hand, at the bottom end of the main board 4 forming the holding space 11 at the lowest stage is formed a bottom piece 27 through the crease 9 in transversal direction.

Here, the goods hanging member in developed state indicated in FIG. 1 is one which has been formed by simultaneously performing punching, drilling, slitting and creasing in a single process on a single piece of resin sheet of prescribed thickness.

To assemble the goods hanging member in developed state indicated in FIG. 1 as shown in FIG. 2, FIG. 3, FIG. 4, the holding space 11 is formed by separating the goods holding piece 10 from the main board 4 along the top and bottom creases 8, 9 in transversal direction. In the present embodiment, the holding space 11 is formed by displacing the main board 4 in the backward direction and the goods holding piece 10 in the forward direction.

Moreover, the folding piece 20 at the upper end is bent on the folding piece 19 in the next stage and the engaging slip 22 is inserted in the notch 21, and then the left and right projections 24, 24 are inserted between the respective folding pieces 19, 20, to form a hanger 25 of 3-layer structure. This hanger 25 is securely held in shape by the inserting structure of the engaging slip 22 in the notch 21 and the inserting structure of the left and right projections 24, 24 between the respective folding pieces 19, 20.

Furthermore, in the case where the displacement preventing pieces 16—are bent up along the crease 15 in longitudinal direction before or after insertion of the dry battery unit 3 in the holding space 11, a goods hanging member of cubic structure as shown in FIG. 2 to FIG. 4 can be assembled.

To hang and support this goods hanging member on the occasion of a display or sale, after inserting the dry battery unit 3 as goods in the holding space 11 formed between the back holding piece 4*b* of the main board 4 and the goods holding piece 10, the flexible wire 29 of the hook member 28 is attached to the hanger 25 by utilizing the fastening holes 26, 26 while the fastening insert 30 at the tip of the flexible wire 29 is engaged in the fastener 28*a* at the base end of the hook member 28 as indicated with fictitious line in FIG. 2, to fasten the hook member 28 to the fastening device in the display space.

Or, it may also be all right to fit a pair of fastening holes 26, 26 in the hanger 25 directly to a pair of fastening devices 31 in the display space as indicated with fictitious line in FIG. 3.

On the other hand, a transparent synthetic resin sheet is used as material constituting the main board 4, so that the goods held in the holding space 11 may be easily verified to provide sales promotional effects. It may also be all right to set the respective elements 4*a*, 14, 16, 27 in the display unit for advertisement of goods and indicate the contents of goods with prints.

According to a goods hanging member of the construction described above, the holding space 11 (see FIG. 3) can be formed by separating the goods holding piece 10 from the main board 4 (relative movement) along the creases 8, 9, because a pair of slits 5, 6 are formed on the main board 4 at a certain distance from each other, to form creases 8, 9 between the edges of the pair of slits 5, 6 and form the portion surrounded by the pair of slits 5, 6 and the creases 8, 9 as a goods holding piece 10.

As a result, it becomes possible to form a goods hanging member with a simple and single piece of material and to also securely hold the goods (see dry battery unit 3) in the holding space 11, thus providing effects of achieving great simplification of manufacturing processes as well as cost reduction of the goods holding piece 10.

Moreover, since said holding space 11 is formed in a plural number at least in either the transversal direction or the longitudinal direction of the main board 4, it produces an effect of enabling to hang and support a plurality or a large number of goods (see dry battery unit 3) by holding them in a limited space.

Furthermore, since displacement preventing piece 16 is formed on both sides of said holding space 11 through crease 15, it produces an effect of preventing displacement in transversal direction of the goods (see dry battery unit 3) held in the holding space 11.

In addition, since a hanger 25 for hanging the goods (see dry battery unit 3) held in the holding space 11 is provided at the upper part of the main board 4 and that this hanger 25 is formed in a multilayer structure with bending of the main board 4 or more specifically the upper piece 4*a* and the bending pieces 19, 20, it produces an effect of promoting improvement of durability of hanging and supporting (improvement of hanging and supporting rigidity) against the weight of the goods to be hung. This multilayer structure is not restricted to 3-layer structure but it may also be a 2-layer structure or a structure with no less than 4 layers.

On top of that, since the holding space 11 is provided side by side in the transversal direction of the main board 4 and that the creases 6, 5 adjoining in the holding spaces 11, 11 provided side by side are formed in the shape of an arc so that the intermediate part of the creases 6, 5 may be depressed, the width L at the center of the main board 4 increases in correspondence to the arched creases 6, 5 the intermediate part of which is depressed, thus producing an effect of preventing deformation by warping of the goods hanging member with this width L.

Still more, since the goods is set as battery (see dry battery 1) or dry battery unit 3 made by integrating a plurality of dry batteries 1, it becomes possible to constitute the goods hanging member with a simple and single material and to securely hold the battery or dry battery unit 3 in the holding space 11, also producing an effect of enabling substantial simplification of manufacturing processes of the goods hanging member.

In FIG. 2, FIG. 3, FIG. 4, the resin film 2 integrating a plurality of dry batteries 1 into unit is omitted for the convenience of illustration.

Yet more, by forming creases 12, 13 for shaping in the neighbourhood of the creases 8, 9 in addition to the creases 8, 9 in transversal direction at the top and bottom ends of the slits 5, 6, as shown in the above-described embodiment, it becomes possible to arrange the shape of the holding space 11 in a shape suitable for holding the dry battery unit 3.

In the correspondence between the construction of the present invention and the embodiment, while the goods of the present invention corresponds to the dry battery unit 3 in the embodiment, the present invention is not restricted to the construction of the embodiment.

For example, other electric components such as small secondary batteries, etc., stationery articles such as paste in the shape of stick, etc. or other articles may be set as goods in place of the dry battery unit 3.

It may also be all right to form said projections 24 in tapered shape to be slender at the outer end side, to improve the workability of insertion between the bending pieces 19, 20.

What is claimed is:

1. A goods hanging member consisting of a single elongated board having a longitudinal first dimension and a transverse dimension shorter than said longitudinal first dimension, said board having defined therein a first pair of parallel slits in said longitudinal dimension and a first pair of parallel creases in said transverse dimension and located at ends of said first pair of parallel slits, wherein said first pair of parallel slits are completely parallel throughout their longitudinal length and define a a first portion of said single elongated board between said first pair of parallel slits and a pair of second portions of said single elongated board outside of said first pair of parallel slits, and a hole formed at a longitudinal end of said board for hanging said member containing said goods, wherein one or more cylindrical goods are insertable with their axes disposed in said transverse dimension and held by and between said first portion of said board and said pair of second portions of said board with said first pair of parallel slits crossing said axes of said goods.

2. A goods hanging member consisting of a single elongated board having a longitudinal first dimension and a transverse dimension shorter than said longitudinal first dimension, said board having defined therein a first pair of parallel slits in said longitudinal dimension and a first pair of parallel creases in said transverse direction and located at ends of said first pair of parallel slits, and a hole formed at a longitudinal end of said board for hanging said member containing said goods, wherein one or more goods are insertable in said transverse dimension and held by a first portion of said board located between said first pair of parallel slits and a pair of second portions of said board located outside of said first pair of parallel slits; wherein said board further defines a second pair of parallel creases located between said first pair of creases in said longitudinal dimension, wherein said first portion of said board located between said first pair of parallel slits and said second portions of said board located outside of said first pair of parallel slits, are folded at said first and second pair of creases so that parts of said first and second portions of said board are substantially parallel with an opening therebetween for holding said one or more goods.

3. The member of claim 2, wherein said board further defines a second pair of slits located between said first pair of parallel slits and extending substantially in said longitudinal dimension, wherein said first portion of said board is divided into a pair of end subparts and a middle subpart by said second pair of slits, and wherein said middle subpart is positioned on substantially the same plane as said second portion, and said pair of end subparts are positioned on another plane, so that said one or more goods are held between said end subparts and said middle subpart and said second portion.

4. A goods hanging member consisting of a single elongated board having a longitudinal first dimension and a transverse dimension shorter than said longitudinal first dimension, said board having defined therein a first pair of parallel slits in said longitudinal dimension and a first pair of parallel creases in said transverse dimension and located at ends of said first pair of parallel slits, and a hole formed at a longitudinal end of said board for hanging said member containing said goods, wherein one or more goods are insertable in said transverse dimension and held by a first portion of said board located between said first pair of parallel slits and a pair of second portions of said board located outside of said first pair of parallel slits; wherein said board further defines a second pair of slits located between said first pair of parallel slits and extending substantially in said longitudinal dimension, wherein said first portion of said board is divided into a pair of end subparts and a middle subpart by said second pair of slits, and wherein said middle subpart is positioned on substantially the same plane as said second portion, and said pair of end subparts are positioned on another plane, so that said one or more goods are held between said end subparts and said middle subpart and said second portion.

5. A goods hanging member consisting of a single elongated board having a longitudinal first dimension and a transverse dimension shorter than said longitudinal first dimension, said board having defined therein a first pair of parallel slits in said longitudinal dimension and a first pair of parallel creases in said transverse dimension and located at ends of said first pair of parallel slits, and a hole formed at a longitudinal end of said board for hanging said member containing said goods, wherein one or more goods are insertable in said transverse dimension and held by a first portion of said board located between said first pair of parallel slits and a pair of second portions of said board located outside of said first pair of parallel slits; wherein said board further defines a plurality of sets of first pair of parallel slits and first pair of creases, with each set being disposed adjacent to each other in the longitudinal dimension.

6. The member of claim 5, wherein said one or more goods are batteries of cylindrical shape with the axis thereof being held in said transverse dimension when inserted and held by said board.

* * * * *